US005368351A

United States Patent [19]

Cuti

[11] Patent Number: 5,368,351

[45] Date of Patent: Nov. 29, 1994

[54] TENNIS BUTLER

[76] Inventor: Philip M. Cuti, 6874 Sedgewick Ct., Ft. Myers, Fla. 33919

[21] Appl. No.: 108,429

[22] Filed: Aug. 19, 1993

[51] Int. Cl.[5] ..... A63B 47/02

[52] U.S. Cl. ..... 294/19.2; 294/141; 248/132

[58] Field of Search ..... 294/19.2, 141–143; 273/29 R, 29 A; 248/128, 132, 150, 157; 56/328.1

[56] References Cited

U.S. PATENT DOCUMENTS

| | | | |
|---|---|---|---|
| 3,804,449 | 4/1974 | Falitz | 294/19.2 |
| 3,820,836 | 6/1974 | Seewagon et al. | 294/19.2 |
| 3,957,297 | 5/1976 | Hanks | 294/19.2 |
| 4,398,716 | 8/1983 | Argibay, Jr. et al. | 294/19.2 X |
| 4,412,697 | 11/1983 | Verde | 294/19.2 |
| 4,461,504 | 7/1984 | Perez et al. | 294/19.2 |
| 4,643,317 | 2/1987 | Wilkinson et al. | 294/19.2 X |
| 4,811,980 | 3/1989 | Ferrari et al. | 294/19.2 |
| 5,086,948 | 2/1992 | Slusarz | 294/19.2 X |
| 5,301,991 | 4/1994 | Chen et al. | 294/19.2 |

*Primary Examiner*—Dean J. Kramer
*Attorney, Agent, or Firm*—Frank A. Lukasik

[57] ABSTRACT

A tennis ball retriever and multi-purpose tennis ball hopper and caddy that holds all of the tennis equipment used during play and practice. The retriever utilizes a container portion incorporating a bottom of transverse rods which are slightly resilient and incorporates a telescoping handle structure used in ball retrieval and as a support stand for the ball container portion. The hopper has side walls that open for easy access to the container.

4 Claims, 12 Drawing Sheets

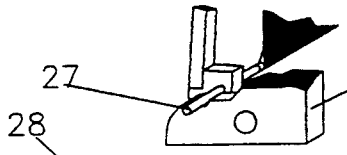
FIG. 13
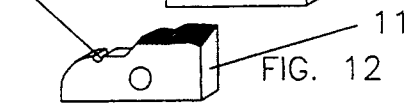
FIG. 12
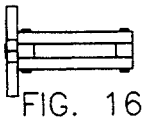
FIG. 16
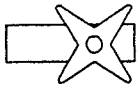
FIG. 15
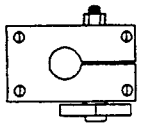
FIG. 14
FIG. 18
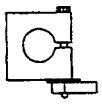
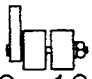
FIG. 19
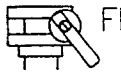
FIG. 17

TENNIS BUTLER

BACKGROUND OF THE INVENTION

1. Field of the Invention

This invention relates generally to a tennis ball retriever, and more particularly to a multi-purpose tennis ball hopper and caddy that holds all of the tennis equipment used during play and practice.

2. Description of the Prior Art

It is well known to provide devices for carrying and/or picking up tennis balls. Such devices are widely used by instructors as well as by players. Examples of such devices are hoppers made of wire construction which are hand carried and lifted to a desired place on the tennis court. These hoppers carry as many as 30 to 100 and can be used to pick stray balls by positioning them over the balls and pressing the ball or balls against the wire construction. Another transport device is a cart that can hold twice as many balls and is pushed around the court. Alternatively, a ball retaining device may be worn by the player.

Various devices have in the past been developed as tennis ball retrievers. One such device is shown in U.S. Pat. No. 4,461,504 to Perez et al which discloses a container having a bottom wall with slotted apertures having thin parallel side edge members through which tennis balls can be squeezed. At least one edge member of each aperture includes a roller to reduce the frictional resistance to the entry of the ball through the aperture. A support is provided for supporting the container with the bottom wall spaced above the supporting surface to prevent wear on the bottom wall.

U.S. Pat. No. 5,086,948 to Slusarz discloses a tennis ball pack dispensing and retrieving apparatus while positioned on a player's back and retrieving balls in another mode of operation upon removal from the back. U.S. Pat. No. 3,957,297 to Hanks discloses a tennis ball retriever comprising a tube having an inlet through which a ball may pass, and a set of arcuate arms pivotally mounted to the tube adjacent the inlet for movement between positions of greater and lesser proximity to the interior walls of the tube. The arms are spring biased towards their position of lesser proximity where stop means are located.

U.S Pat. No. 3,820,836 to Seewagen et al discloses a tennis ball retriever device comprising a receptacle having an open top and a substantially open bottom for holding a plurality of tennis balls. An access arrangement normally in substantially horizontal planar position is provided in the bottom of the receptacle for admitting tennis balls into the receptacle and for preventing balls from falling out. The access arrangement comprises an access device yieldable under the pressure of a tennis ball in a direction into the receptacle to permit the entry of a tennis ball and instantly returnable to prevent the egress of a tennis ball from the receptacle.

U.S Pat. No. 4,412,697 to Verde discloses a tennis ball retrieving storage container having a pair of handles hingedly fixed thereto which may be folded to a downwardly extending position supporting the container on a playing surface. The retrieving device includes a plurality of parallel rods extending across the bottom of the container. When folded upwardly, the handles of the container enable an operator to both carry and retrieve balls from a playing surface without bending or stooping.

U.S. Pat. No. 3,804,449 to Falitz discloses a tennis ball retriever having a handle in the form of a yoke and a pair of second engaging rings interconnected by spaced bars, one of which is removable to provide for access of tennis balls picked up through the spaced bars after rolling the rings along the ground.

Conventional ball storage devices with handles provided on containers are limited to the single function of carrying the container around. It is generally desirable for the container to be adapted for retrieving the balls from the court surface without an undue amount of bending and stooping. While retrieving tennis balls containers are available, they possess certain inherent disadvantages which the present invention overcomes.

The present invention provides such improvements by utilizing a container portion incorporating a bottom of transverse rods which are slightly resilient. The present invention, as further set forth below, also incorporates a telescoping handle structure used in both ball retrieval and as a support stand for the ball container portion.

SUMMARY OF THE INVENTION

The present invention relates to an improved tennis ball retrieval and storage apparatus. In addition, the invention provides a multi-purpose tennis ball hopper, personal handy butler, (or caddy) that holds all of the tennis equipment used during play and practice. Some of the uses for the present invention include:

- a small storage unit designed as a holder for new and practice tennis balls and other related tennis play equipment, e.g., towel, sweat bands, etc.;
- a lightweight practice serving caddy;
- a tennis ball hopper that will pick up and hold up to 40 tennis balls;
- a place to keep all of the tennis equipment handy together and organized during game play;
- a space saver piece of sports equipment, that when the handle is reclined, will take up much less space than any other conventional tennis hoppers in use today;
- a unisex and juniors product, designed for ease of use by men and women and juniors.

While the present invention is being used as a handy butler, it will (hang) hold up to two tennis rackets on the handle, a towel may drape over the center bar, and the extra head and wrist sweat bands may droop over the cross bars of the handle. The strength of the handle when expanded may also support a tennis bag hung over one of the cross bars.

It is therefor an object of the present invention to provide a tennis ball retriever that is light in weight and simple of construction, capable of being manufactured out of readily available materials and which is efficient in use.

These, together with the various ancillary objects and features of the invention which will become apparent as the following description proceeds, are attained by this tennis butler, a preferred embodiment of which has been shown in the accompanying drawings by way of example.

BRIEF DESCRIPTION OF THE DRAWINGS

FIG. 12 is a sectional view of a side of the opening flap.

FIG. 13 is a sectional view of a side of the opening flap engaged in a latching position.

FIG. 14 is a top view of the top clamp of the present invention.

FIG. 15 is a side view of the top clamp of the present invention.

FIG. 16 is a side view of the top clamp of the present invention.

FIG. 17 is a side view of the bottom clamp of the present invention.

FIG. 18 is a top view of the bottom clamp of the present invention.

FIG. 19 is an end view of the bottom clamp of the present invention.

DETAILED DESCRIPTION OF A PREFERRED EMBODIMENT

Figure 1:
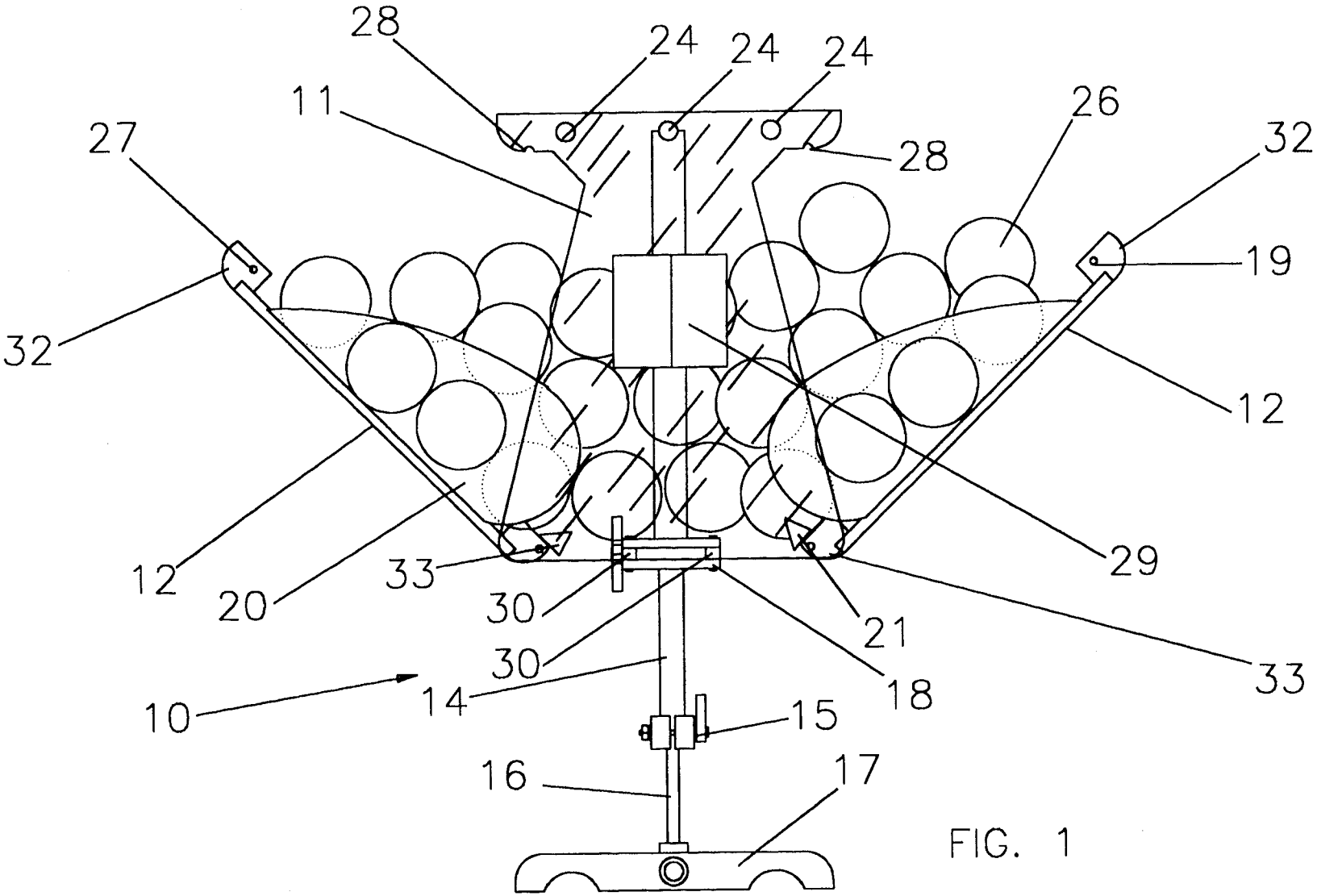
FIG. 1 is a side view of the tennis butler in its expanded position with the ball hopper open.
Figure 2:
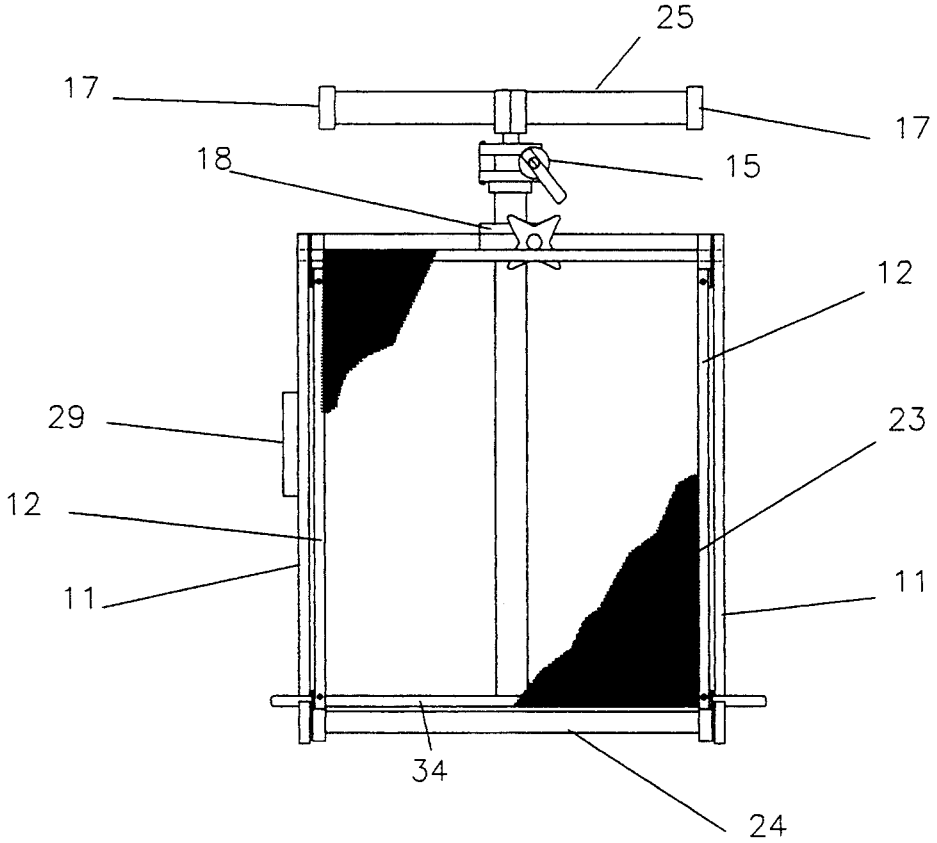
FIG. 2 is a front view of the tennis butler of the invention in its carrying mode.

With continuing reference to the accompanying drawings wherein like reference numerals designate similar parts throughout various views, reference numeral 10 generally designates the tennis butler constructed in accordance with the concept of the present invention.

Figure 4:
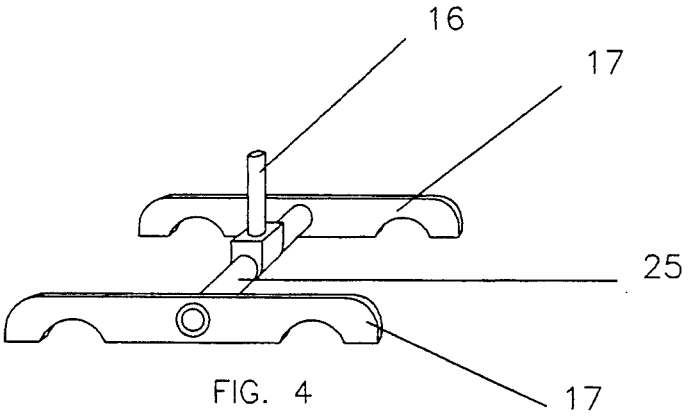
FIG. 4 is a perspective view of the carrying handle, or base of the tennis butler.
Figure 5:
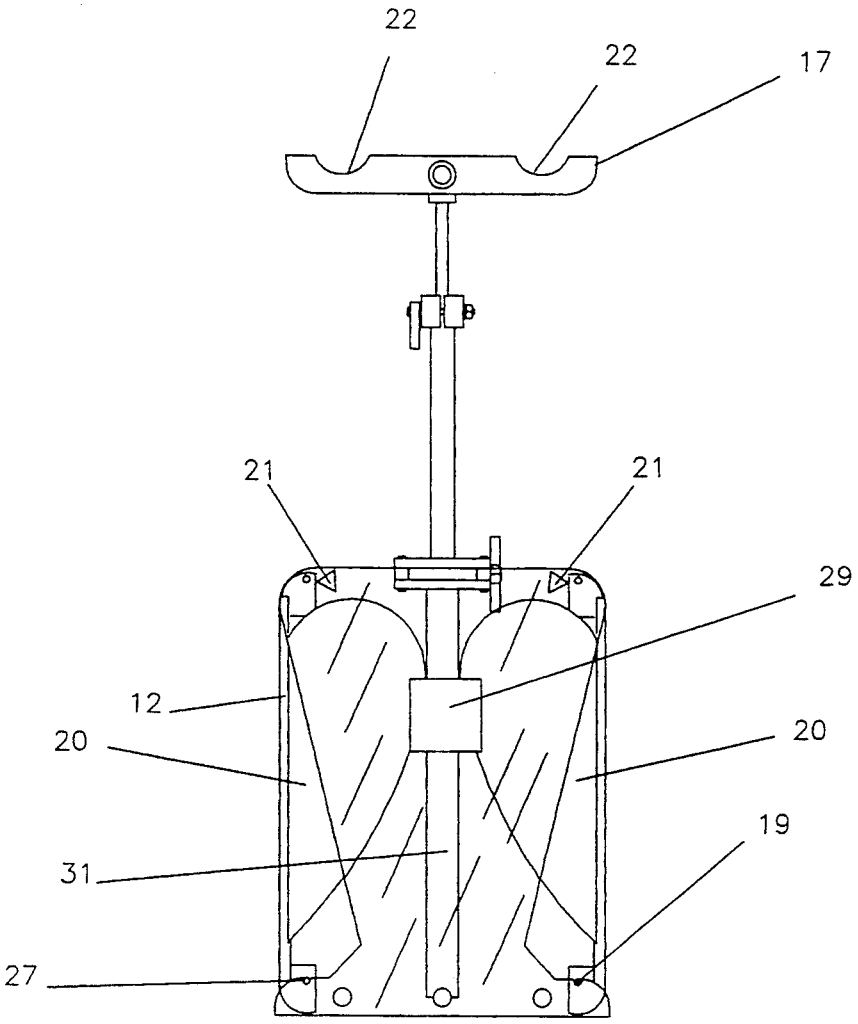
FIG. 5 is a side view of the tennis butler of the invention in its accessory carrying position.
Figure 6:
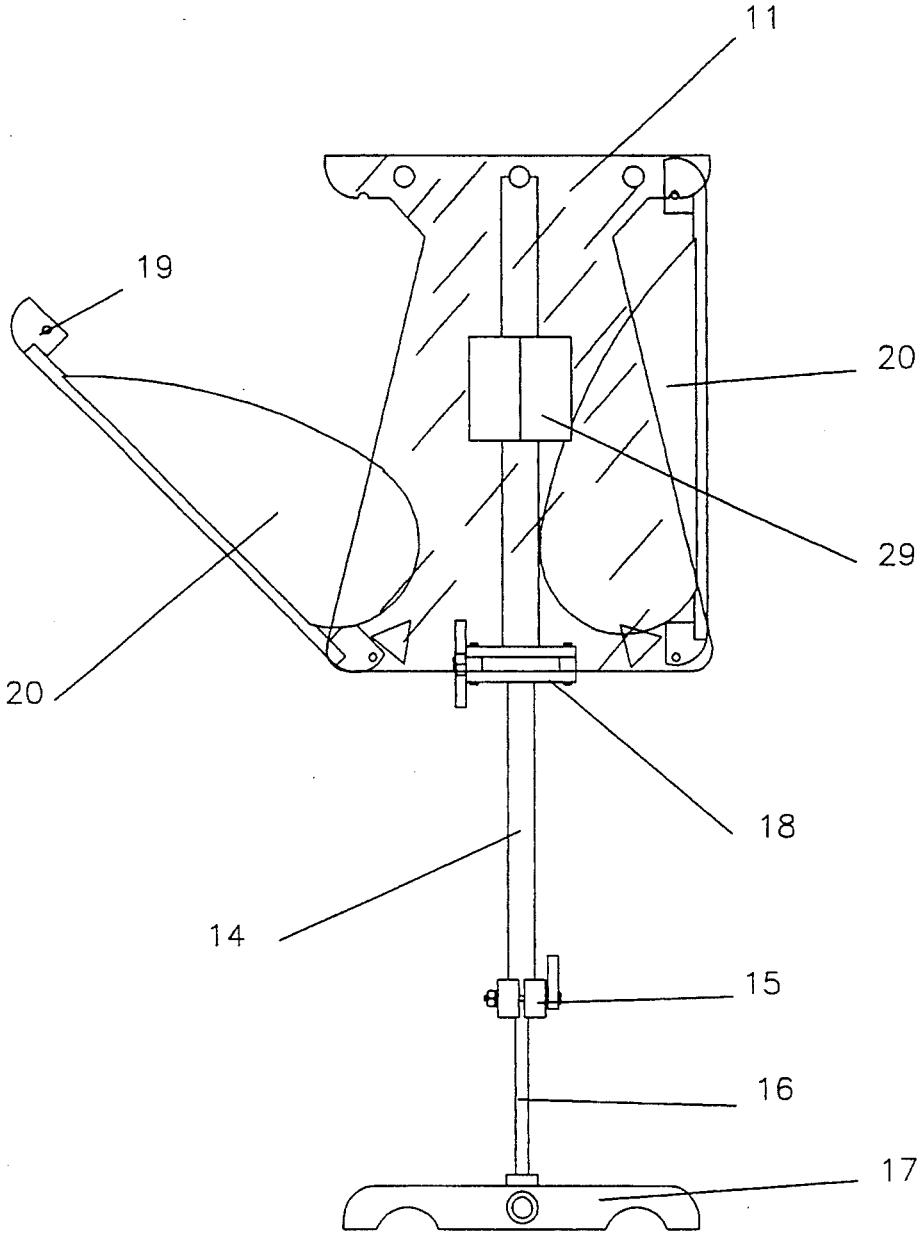
FIG. 6 is a side view of the tennis butler of the invention with one side open for access to the tennis balls.

The tennis butler 10 comprises several major parts including the end frames 11, side closure brackets 12 and base supports 17. Vertically extending telescoping rod comprises bottom vertical post 16, middle vertical post 14, and top vertical post 31. As shown in FIG. 4, post 16 is affixed to horizontal base support rod 25 which is affixed at each of its ends to base supports 17. Bottom vertical post 16 is slidably inserted into the bottom end of middle vertical post 14 where it is gripped by post clamp 15 which is affixed to the bottom of vertical post 14. Vertical post 14 is inserted at a top end into top vertical post 31 to complete the telescoping assembly. Vertical post 31 is affixed at its bottom end to upper clamp 18 and at its upper end to a center ball retriever rod 24.

The ball hopper of the present invention comprises the two end frames 11, held apart in vertical spaced relationship by a pair of horizontal mounting supports 30 and the ball retriever rods 24. The mounting supports 30 are fastened at their center portion to the upper clamp I 8 which is affixed to the lower end of top vertical post 31. Side closure brackets 12 are held in spaced apart relationship by rods 34 running through holes in upper tips 32 and lower tips 33. The rods 34 are used in a manner such as curtain rods to string the nylon mesh panels 23 to form the side walls of the ball hopper. Upper rods 34 are slightly longer than lower rods 24 as shown at ends 19 and 27. The elongated ends 19 and 27 also serve to latch into notches 28 at the top of end frames 11 to hold the side closure brackets in a locked, closed position. Stops 21 are provided on the inside face of end frames 11 to support side closure brackets 12 in an open position.

Side closure panels 20 are affixed to the outside surfaces of side closure brackets 12 to provide a side barrier when side closure brackets 12 are in the opened position as shown in FIGS. 1, 6, 7 and 9. FIGS. 12 and I 3 are sectional views illustrating the engagement of the end of mesh support rod 27 as it engages latching notch 28. The latching action comprises a slight bending of mesh support rod 27 as it passes over the cammed surface of the upper extension of end frame 11.

Figure 3:
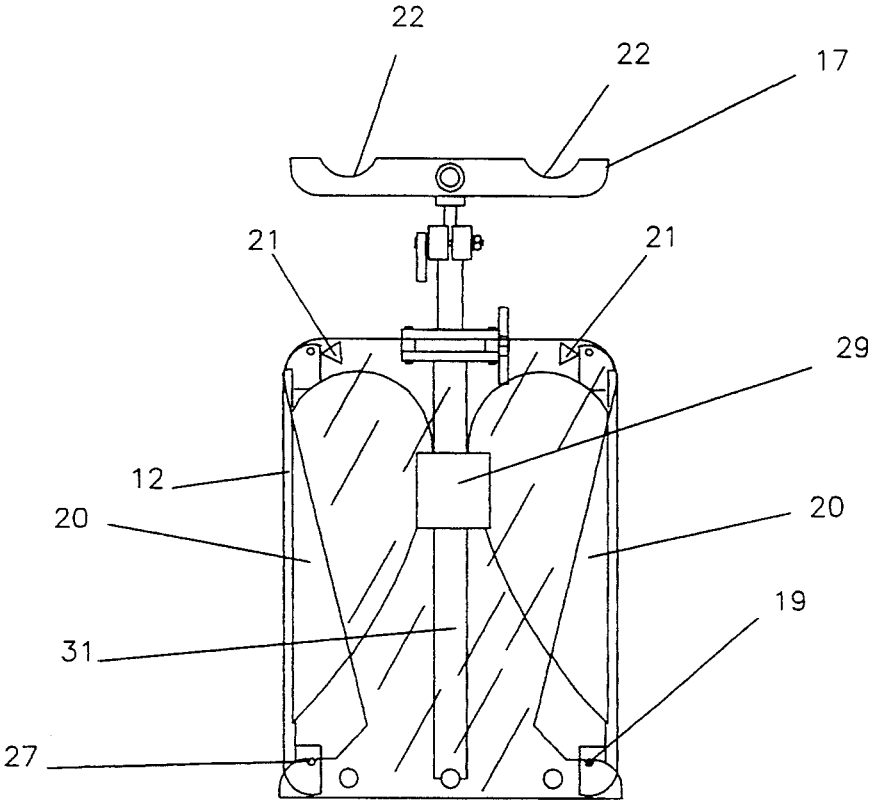
FIG. 3 is a side view of the tennis butler of the invention in its carrying mode.

FIGS. 14–16 show various views of upper clamp 18 which provides gripping friction by squeezing the bottom of top vertical post 31 to grippingly engage the middle vertical post 14 to lock post 14 in an extended position as shown in FIG. 1 or a retracted position as shown in FIG. 3.

FIGS. 17–19 show various views of post clamp 15 which provides gripping friction by squeezing the bottom of middle vertical post 14 to grippingly engage the bottom vertical post 16 in an extended position as shown in FIG. 1 or a retracted position as shown in FIG. 3.

Figure 7:
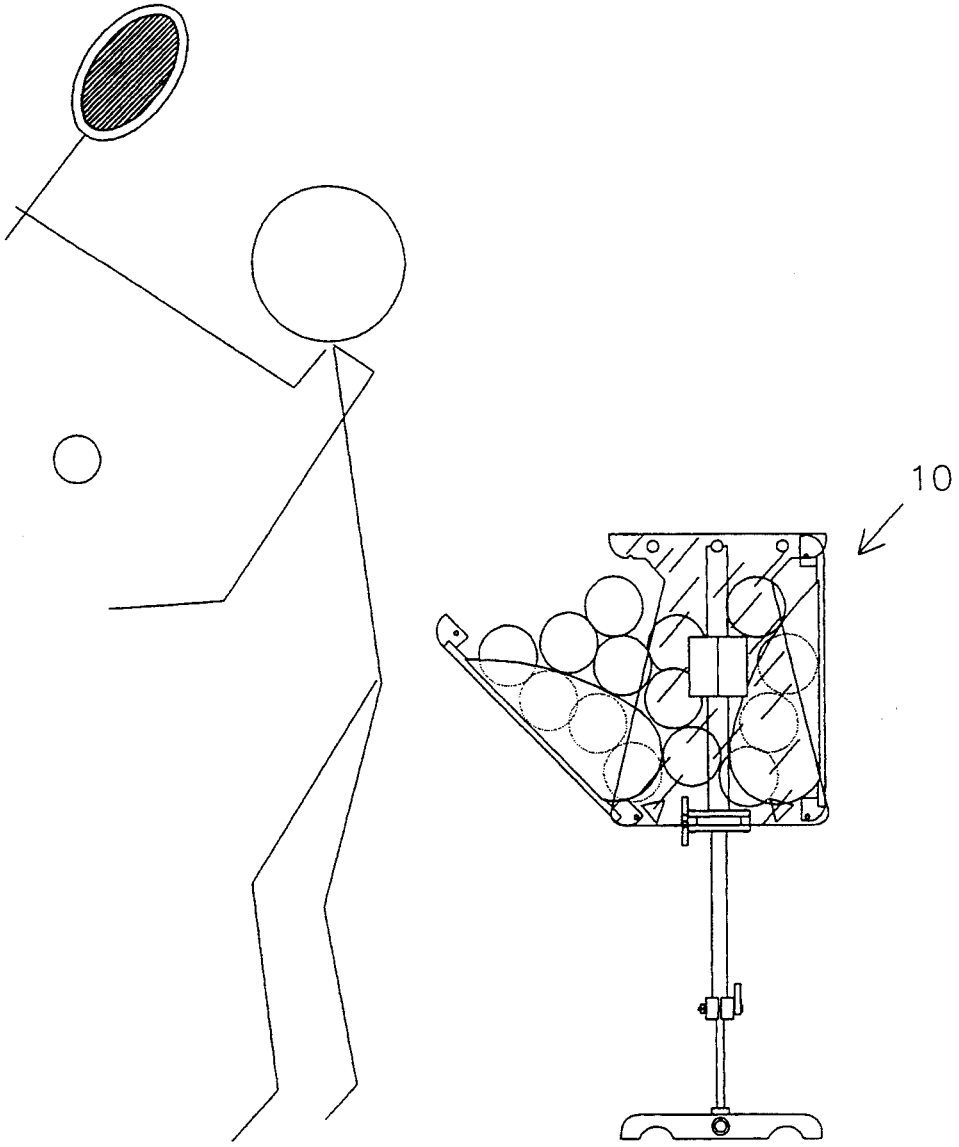
FIG. 7 is a side view of the tennis butler of the invention with one side open for access to the tennis balls with a tennis player serving a ball.

FIG. 7 is a side view of of the tennis butler of the present invention with one side open for access to the tennis balls by a tennis player who is apparently learning to serve. The middle vertical post 14 and the bottom vertical post 16 are shown in their fully extended position similar to the position shown in FIG. 6.

Figure 8:
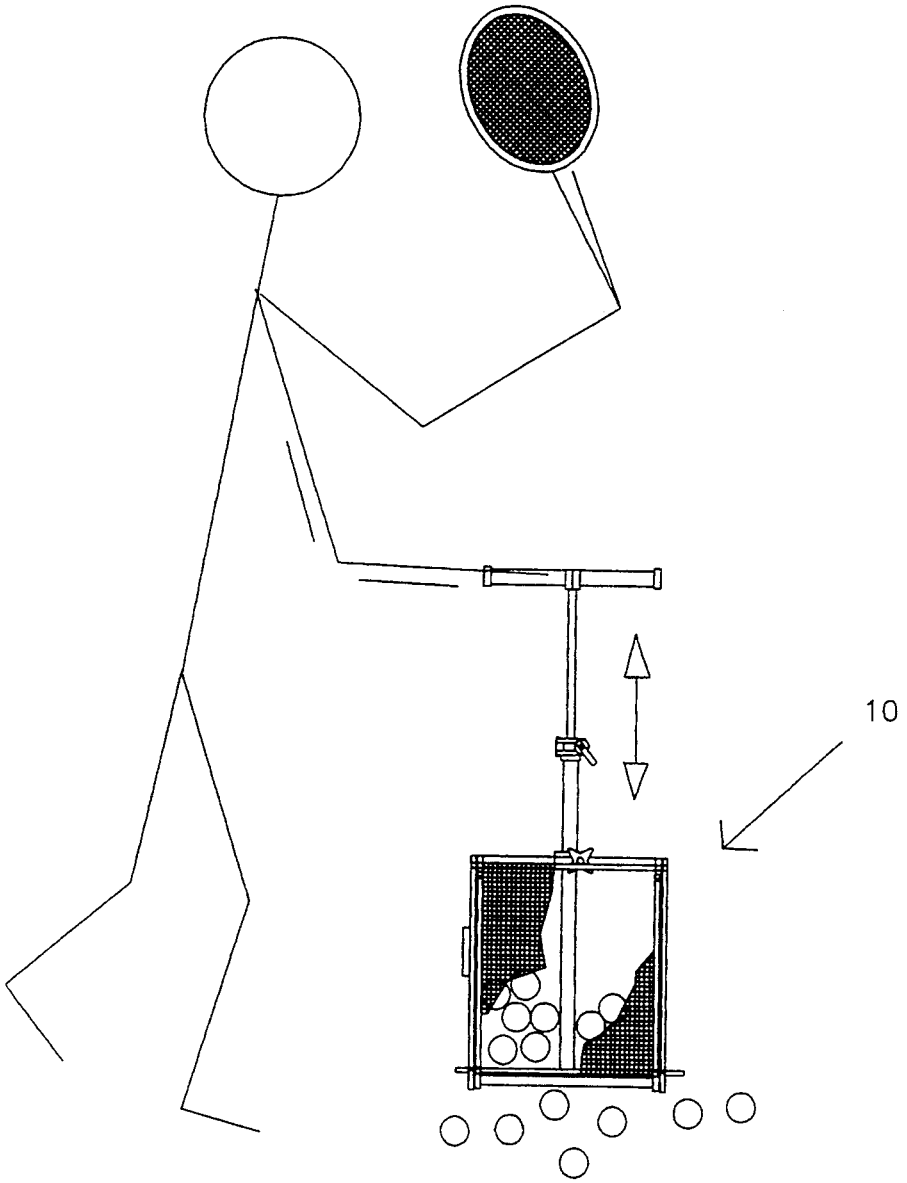
FIG. 8 is a front view of the tennis butler of the invention showing a tennis player retrieving tennis balls with the present invention
Figure 9:
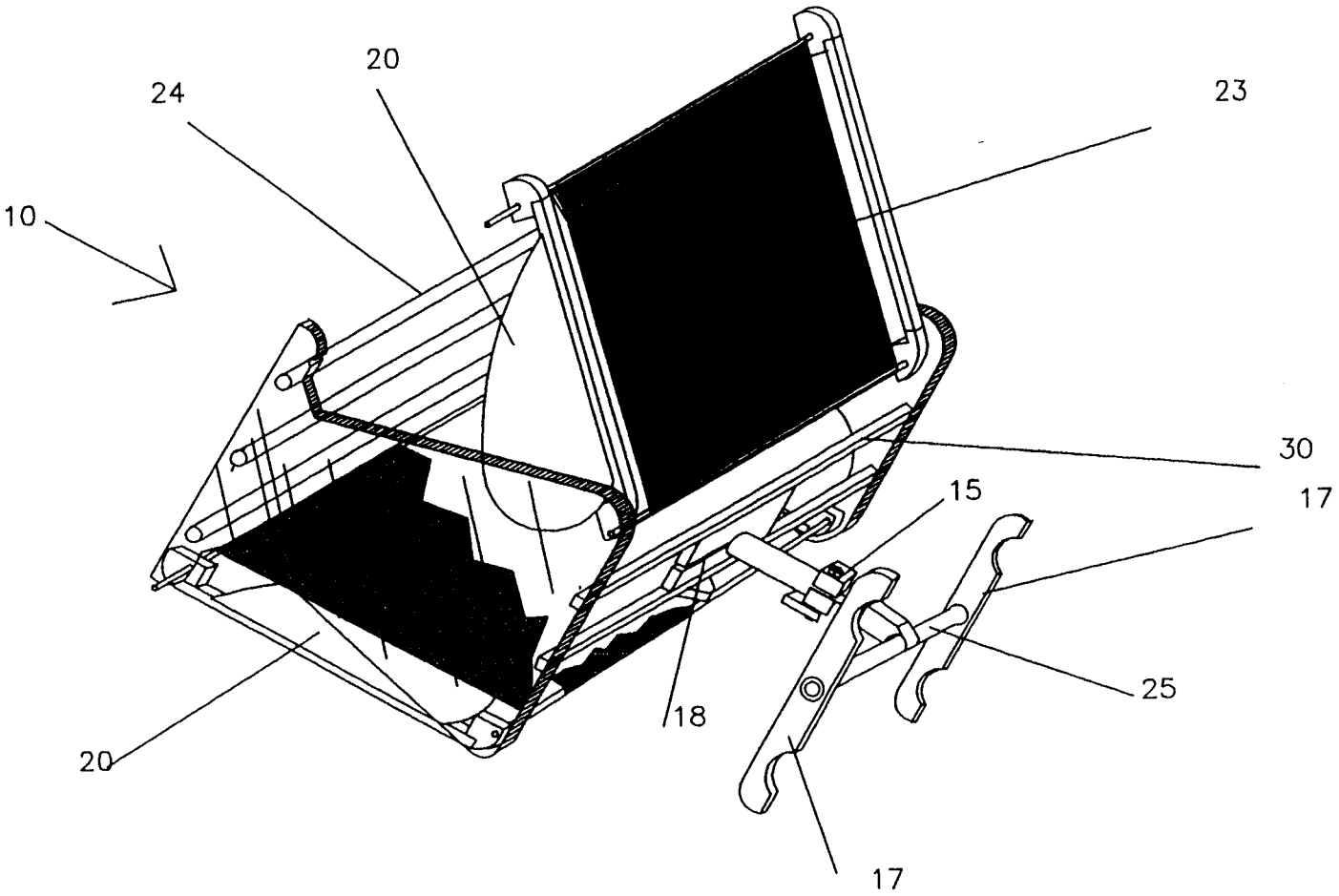
FIG. 9 is a bottom perspective view of the tennis butler of the invention with one side open for ball access.
Figure 10:
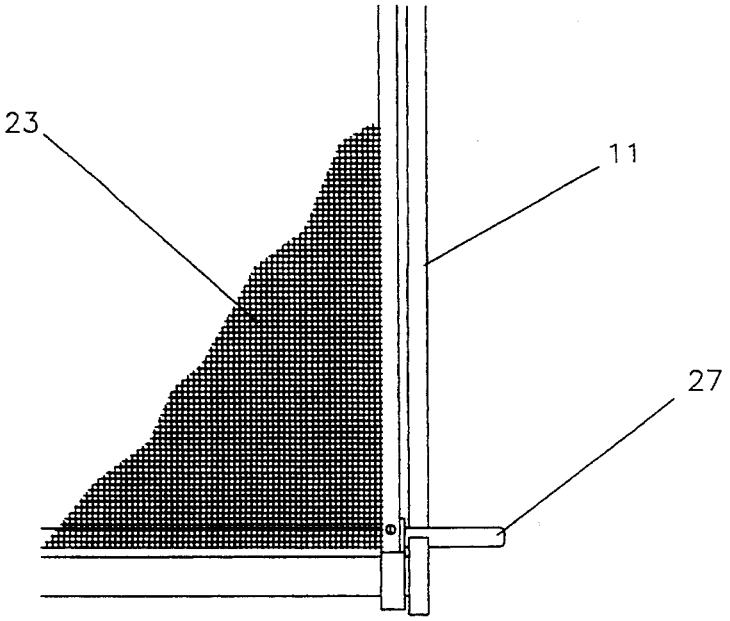
FIG. 10 is a front view, partially in section, of the side of the hopper of the present invention.
Figure 11:
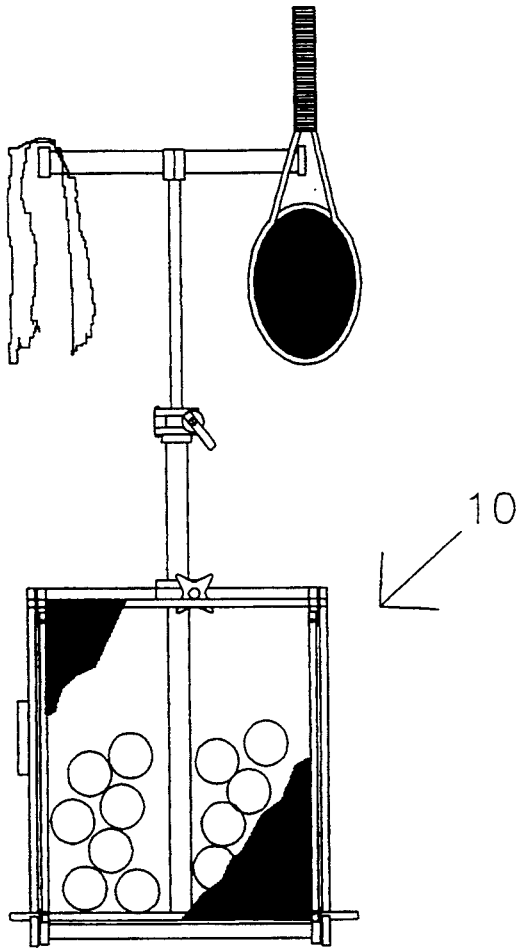
FIG. 11 is a front view of a tennis butler of the present invention in its fully extended caddy position.

FIG. 8 is a front view of the tennis butler showing the tennis player retrieving the tennis balls with the present invention. As will be noted in FIG. 8, once the tennis ball 26 is positioned between the plurality of spaced apart ball retrieval rods 24, these rods are spaced apart from one another a distance less than the diameter of the balls to be retrieved. This construction greatly facilitates the ingress of tennis balls 26 through the bottom of the hopper and prevents their egress after retrieval despite the weight of additional balls positioned above it.

To complete the versatility of the present invention a small pouch 29 is affixed to the end frame 11 to hold such smaller items such as cash, keys, wallets, etc.

While the present tennis butler is generally designed as a better hopper, the present invention has achieved a multi-function product. Most tennis ball hoppers are constructed of a heavy steel substance using a rubberized coating. The present product has reduced the weight, which is approximately one half that of a normal hopper in weight. It was possible to reduce the size because only the exact dimensions needed were used. The present invention is less cumbersome when stored or used than any other prior art hoppers. The present invention was designed with the idea that men, women, or juniors may have ease of use.

The preferred embodiment is constructed from lightweight tubing, nylon fabric netting material, and plastic or nylon parts. The construction of the handle/base will telescope out for convenience of use and ease of storage. The present invention offers the availability of all of the equipment needed for playing tennis in a carefully organized fashion and made readily available to the tennis player. The product was designed for multi-purpose use, i.e., for practice and playing tennis. The major difference is in the appearance, function, weight, size, design and completeness, with multi-purpose use in mind.

What is claimed is:

1. A tennis ball retrieving, storing, and serving apparatus for collecting tennis balls from a playing surface, storing said balls for subsequent use, and conveniently providing said tennis balls for use, said apparatus comprising:

a tennis ball hopper comprising side and end walls, a first portion of said end walls having three ball retriever rods in parallel, spaced apart relationship affixed to and separating said end walls, a second portion of said end walls having a pair of horizontal supports in parallel, spaced apart relationship, affixed to and separating said end walls, said horizontal supports having a clamp affixed thereto at a point midpoint between said end walls, a first end of said side walls hingedly mounted at said second portion between said end walls, and a second end of said side walls engaging said first portion of said end walls, and a top vertical post having a first end mounted within said clamp and having a second end affixed to a ball retriever rod, and a base, handle, support means, slidably adjustable within said top vertical post for selectively extending or shortening the length of said support means, said support means extended for supporting said tennis ball hopper for access to said tennis balls, and for supporting said hopper for tennis ball retrieval, and shortened for use as a carrying handle.

2. A tennis ball retrieving, storing, and serving apparatus as claimed in claim 1 wherein said side walls each comprise a pair of side closure brackets with nylon mesh panels stretched therebetween and side closure panels affixed thereto for enclosing said tennis balls in a closed or open position.

3. A tennis ball retrieving, storing, and serving apparatus as claimed in claim 1 wherein said support means comprises base supports, a first vertical post affixed to said base support, a second vertical post slidably mounted over said first vertical post, and a post clamp affixed to said second vertical post for locking said first and second vertical posts at a specific length.

4. A tennis ball retrieving, storing, and serving apparatus for collecting tennis balls from a playing surface, storing said balls for subsequent use, and conveniently providing said tennis balls for use, said apparatus comprising:

a tennis ball hopper comprising side and end walls, a first portion of said end walls having three ball retriever rods in parallel, spaced apart relationship affixed to and separating said end walls, a second portion of said end walls having a pair of horizontal supports in parallel, spaced apart relationship, affixed to and separating said end walls, said side walls each comprising a pair of side closure brackets with nylon mesh panels stretched therebetween and side closure panels affixed thereto for enclosing said balls in a closed or open position, a first end of said side walls hingedly mounted at said second portion of said end walls between said end walls, and a second end of said side walls engaging said first portion of said end walls, and a top vertical post having a first end mounted within said clamp and having a second end affixed to a ball retriever rod, and a base, handle, support means, slidably adjustable within said top vertical post for selectively extending or shortening the length of said support means, said support means comprising base supports, a first vertical post affixed to said base support, a second vertical post slidably mounted over said first vertical post, and a clamp affixed to said second vertical post for locking said first and second vertical posts at a specific length, said support means extended for supporting said tennis hopper for access to said tennis balls, and for supporting said hopper for tennis ball retrieval, and shortened for use as a carrying handle.

* * * * *